United States Patent [19]

Braumann et al.

[11] 4,167,717

[45] Sep. 11, 1979

[54] ELECTROMAGNETIC RELAY

[75] Inventors: Gundokar Braumann, Neuried; Adolf Schön, Söcking, both of Fed. Rep. of Germany

[73] Assignee: Siemens Aktiengesellschaft, Berlin and Munich, Fed. Rep. of Germany

[21] Appl. No.: 810,391

[22] Filed: Jun. 27, 1977

[30] Foreign Application Priority Data

Jun. 29, 1976 [DE] Fed. Rep. of Germany ..... 2629052

[51] Int. Cl.[2] ..... H01H 9/02

[52] U.S. Cl. ..... 335/202; 335/278

[58] Field of Search ..... 335/128, 132, 197, 200, 335/202, 203, 262, 278

[56] References Cited

U.S. PATENT DOCUMENTS 3,119,954 1/1964 Bachi ..... 335/262

3,701,062 10/1972 Koga et al. ..... 335/202 X

FOREIGN PATENT DOCUMENTS 33572 6/1964 Finland ..... 335/202

*Primary Examiner*—George Harris

[57] ABSTRACT

An electromagnetic relay is described of the type wherein, upon energization, an armature, while being attracted to a yoke, is repelled by a flux plate and wherein parts of the magnetic circuit are utilized for electrical conduction. A coil form and plug-in shaft are provided for holding the relay windings and the magnetic circuit parts. Projections are provided for defining the position relationships between the relay windings and the magnetic circuit parts.

6 Claims, 7 Drawing Figures

ELECTROMAGNETIC RELAY

BACKGROUND OF THE INVENTION

The invention relates to an electromagnetic relay which operates on the flux superposition principle. A relay of this type has an armature which, upon energization, is attracted by a yoke while at the same time is repelled by a flux plate, and wherein parts of the magnetic circuit are utilized for the electrical conduction.

A wide variety of this type of relay has been known for some time. Examples are described in West German Pat. No. 1,026,870 and a publication of Siemens Aktiengesellschaft entitled, "High-Speed Relay with Noble Metal Contacts" (publication No. N 109/1147.101, (1973). Heretofore, they have been used in multiple relay strips for the construction of switching matrices. An extremely cost-effective production method was found permitting fully automatic fabrication of strips having five multicontact relays each on a common carrier element by mounting coils onto and inserting pressed bent components into guides provided therefor.

A disadvantage in this form of construction, however, is that the coils to be used must be wound into self-supporting coils so as to be able to push them up on coil forms at prespecified points in view of the space-saving design of a strip of five closely packed multicontact relays. Since it would be a great advantage to make this type of magnetic circuit, particularly for use with printed circuit boards or the like, one way of approaching this fabrication problem is to make use of a maximum number of existing parts of the relay so as to avoid new expense or alternatively, to diminish the number of fabrication steps found to be inconvenient.

SUMMARY OF THE INVENTION

In accordance with the invention, the above and other objects are achieved in that there is provided as a carrier components at least one coil form and one plug-in shaft for holding the windings and the magnetic circuit. The positions of the windings and magnetic circuit parts relative to one another are defined by indexing means preferably formed by positively interlocking projections and by the projections of the magnetic circuit inserted in guides provided therefor.

The magnetic circuits of prior relays are formed by substantially U- or L-shaped parts which, overlapping each other, are inserted from various sides into two shafts of a plastic component. Thus, the cover-up of at least one side of the coil form of the prior relays by the plug-in shaft for the magnetic circuit, which prevents the coil from being wound freely on an automatic winding unit, is obviated by the invention.

The coil form for the winding process is an already known coil form having two flanges and a component connecting them. In a suitable construction of the flanges, the coil form may be provided in a manner in itself known by soldering lugs equal in number to the number of terminal leads and wound automatically as desired on a winding machine also in a manner in itself known. The coil form needed for using the already known components is completed after the winding by interposing a plug-in shaft running parallel to the coil axis and subsequent insertion of the magnetic circuit.

According to a further development of the invention, the plug-in shaft may be introduced into flared or broadened portions of the coil flanges embracing at least part thereof. Advantageously, this arrangement permits the fabrication of the guide of the plug-in shaft parallel to the coil axis simultaneously with the fabrication of the coil form, thereby obviating the need for additional manufacturing processes or even connecting elements.

It may be advantageous to design the plug-in shaft and the guides so that the position and direction of the module are defined. Accurate insertion of additional pieces is mandatory, since the constituent parts of the relay must be positioned with precision. These requirements for ensuring accuracy further make it advisable to equip the coil form and the plug-in shaft with guides for various laminated-spring-type magnetic members. It is quite possible to provide quadrangular or rectangular guides in the coil form and in the plug-in shaft and to insert therein the constituent components, using insulation to separate them. However, guides that can be produced with great precision via the injection-molding process are preferred so as to permit easy and correct insertion of the magnetic members or their laminated-spring-type projections. These fabrication steps, too, can be carried out automatically. For practical reasons, recesses or ribs of the guides can form indexing linkages with resilient projections of the magnetic members, these indexed linkages being provided for fixing the final position and ensuring the proper functioning of the relay.

The known structure of this type of relay provides for each coil shaft and plug-in shaft magnetic members and contact members which together constitute a twin contact. However, according to a further practical embodiment of the invention, the flanges may have flared or broadened portions for holding in position two plug-in shafts arranged side by side. It goes without saying that the coil shaft, too, has a broadened portion, causing a change in the winding area of the coil. However, this type of relay can operate four contacts simultaneously. It is designed so that the terminals of all the contacts of this relay are packed very closely together.

According to another practical embodiment of the invention, flared or broadened portions of the flanges can hold in position two plug-in shafts lying on opposite sides of the coil. This relay, whose contact terminals for the four contacts are located at widely separated points, can perform the same functions as the relay described hereinabove in another arrangement, such as may be required on printed circuit boards and the like.

Elaborating upon this concept, preferably, flared or broadened portions of the flanges on two opposite sides of the coil each hold two plug-in shafts arranged side by side. This relay, which can operate eight contacts simultaneously, only needs one separate coil form with special windings: the remaining parts (e.g., plug-in shafts and magnetic members) may also be employed as in the previously described relays.

The magnetic members are provided with soldering lugs on one end of the relay in continuation of the direction of insertion. Advantageously, the soldering lugs are provided with blade-shaped ends of metal arranged in a given pattern. These metal ends are provided for the reception on a mechanically produced wiring carrier in which the individual connecting points are provided in a given pattern and may be used as a through-connection and as soldering lugs in holes and, if properly constructed, even in sockets. The blade-shaped ends of metal may be pressed bent components connected at one end with the soldering lugs, the area immediately ahead of the free end being held in guides of the coil flanges. With the parts so designed, one can fabricate uninsulated circuits over fairly long distances, since both at the end with the soldering lugs and in the guide region provision is made for locking the comparatively rigid connecting elements. In addition, with the guides immediately ahead of the free end, one can impose strict adherence to the grid pattern and achieve a comparatively great rigidity of the blade-shaped ends for insertion in their spring stops.

BRIEF DESCRIPTION OF THE DRAWINGS

The principles of the invention will be described with reference to preferred embodiments, constructed accordingly, shown in the drawings, wherein.

DETAILED DESCRIPTION OF THE DRAWINGS

Figure 1:
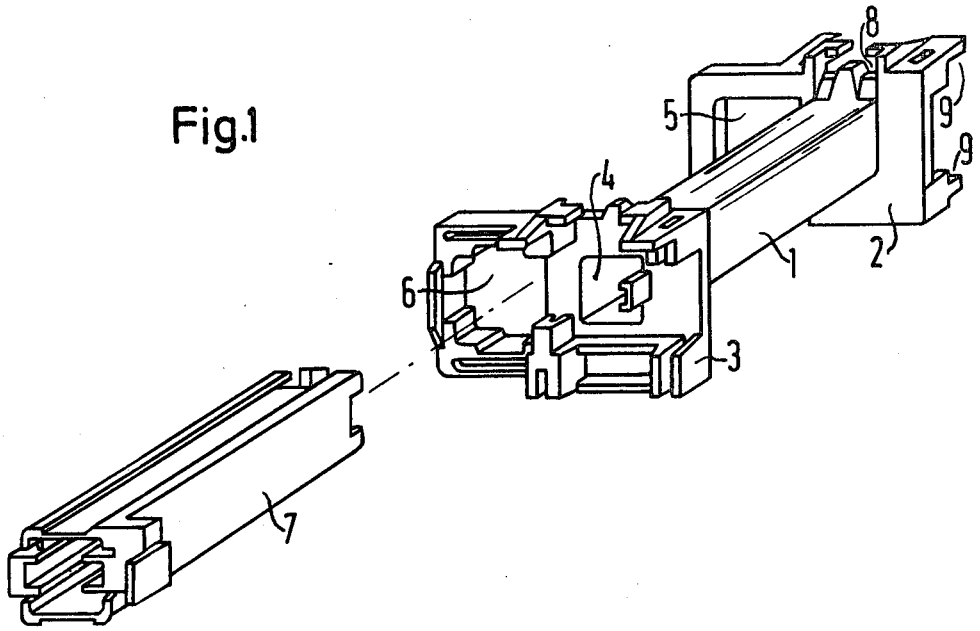
FIG. 1 is an enlarged oblique view of a coil form and plug-in shaft according to the invention.

In FIG. 1, coil form 1 carries two flanged members 2 and 3 at either end of its substantially quadrangular center piece. This center piece has a comparatively thin wall and forms a shaft 4 for receiving plug-in modules, whose cross sections have ribs and channels 41 for guiding the plug-in modules. In the flared or broadened portions shown on the left in the drawing, flanged members 2 and 3 have openings 5 and 6 for receiving a plug-in shaft 7. Opening 5 has a quadrangular configuration and has the same cross section as plug-in shaft 7. Opening 6 has noses or keys and recesses or keyways and in this way prevents the plug-in shaft from being inserted incorrectly. This plug-in shaft is likewise quadrangular and has a comparatively thin wall and, like shaft 4 in th coil form, it has in its interior channels $7^1$ and ribs for guiding the modules to be plugged-in. Recesses 8 and 9 in flange member 2 are provided for the insertion of the wire in the case of automatic winding or for holding soldering lugs for the terminal leads. In a fully automatic winding process, the coil form shown may be fitted with soldering lugs and provided with two or more windings, and the circuits between the terminal leads and the soldering lugs are also produced automatically. In a suitable automatic manufacturing unit, the completely wound coil form is provided with the plug-in shaft in a further fabrication step, and the further modules are gradually and automatically inserted in subsequent fabrication steps.

Figure 2:
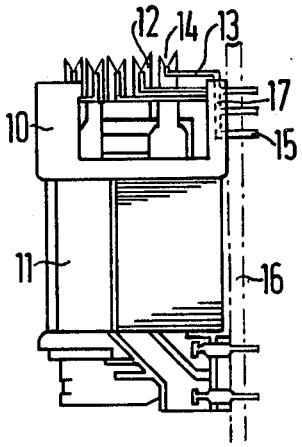
FIGS. 2 and 3 are two views of a 4-contact relay in accordance with the invention.
Figure 3:
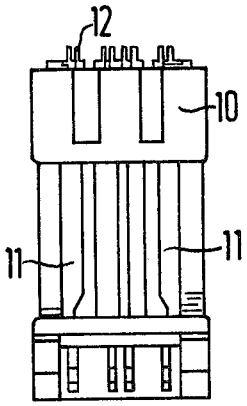

FIGS. 2 and 3 show a relay fabricated in this manner and having a coil form 10 equipped with two plug-in shafts 11 arranged side by side at one end of the relay. Since the coil form shown in FIG. 1 has flared or broadened flanges, each having two openings 5 and 6 arranged beside each other on the same side, it stands to reason that a separately fabricated double plug-in shaft may also be employed in one opening only. The plugged-in modules are provided with soldering lugs having wire leads brought out to the right via passed bent components 13. V-shaped recess 14 in each of the soldering lugs 12 permits automatic insertion and clamping of the free ends of the pressed bent components, so that these are held for passing across a common dip-soldering bath. The other ends 15 of the pressed bent components have a blade-like configuration and are provided for connecting the relay to a circuit board 16 not shown in detail by inserting them in appropriate holes. They may be connected to this board, again by passing them through a common solder bath and then connected to the electrical supply. Between the ends 15 and the soldering lugs the pressed bent components slide in shaft-like recesses 17 of coil form 10 so as to give adequate stability for connection on boards or connectors.

Figure 4:
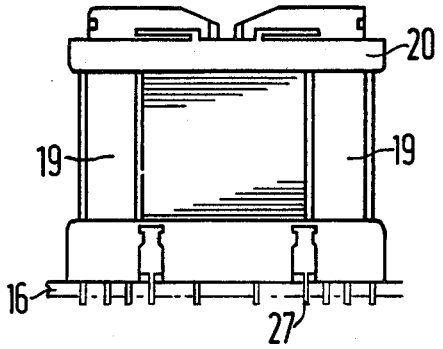
FIGS. 4 and 5 are two views of a 4-contact relay using twin contact construction.
Figure 5:
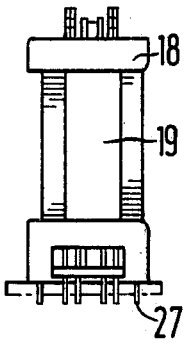

Another type of relay is shown in FIGS. 4 and 5. FIG. 5 shows the design of a twin-contact relay. In this view, coil form 18 and plug-in shaft 19 correspond to those of FIG. 1. FIG. 4 shows how a 4-contact relay may be formed by two twin-contact relays placed on opposite sides. Coil form 20 in this figure is a mirror-image or duplicate of the coil form of FIG. 1 and carries a plug-in shaft 19 on either side.

Figure 6:
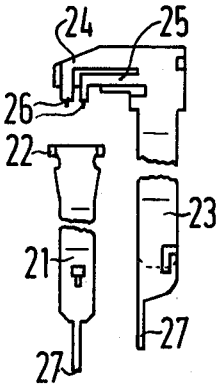
FIGS. 6 and 7 are slide-in modules for the FIGS. 4 and 5 relays.
Figure 7:
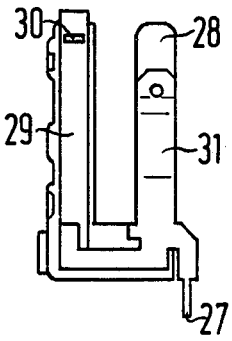

The modules necessary for completing the relay are shown in FIGS. 6 and 7. FIG. 6 shows an armature stop 21, whose upper end having a pattern of noses or keys 22 is guided in the coil form. The adjacent substantially L-shaped magnetic member 23 acts as a counter contact for the armature and has on its two slotted bent members 24 and 25 vertically mounted contact wires 26 which, together with contact wire 30 of FIG. 7, form two clearly defined contact points. The blade-shaped ends projecting downwardly are the terminals of the constituents parts. They can also be seen in FIGS. 4 and 5 and are provided for mounting on a printed circuit board 16 likewise not shown in detail, where they connect the relay via mechanical and electrical means in a common soldering bath.

FIG. 7 shows two substantially U-shaped members arranged one above the other. The lower member is yoke 28 consisting of a completely isolated magnetic member. The member thereabove comprises an armature 29 having contact wire 30 mounted thereon which, together with the vertical contact wires of FIG. 6 forms a twin contact. There is welded on the armature an L-shaped spring strip 31 which secures it in position and carries soldering lugs 27. On the opposite side, yoke 28 is provided with a mirror-image parts arrangement and thus operates with two contacts from one pole piece.

As shown in FIG. 2, the arrangement of FIG. 4 could readily be expanded, i.e., two twin-contact arrangements of this type could be located on either side of the relay one above the other in the plane of projection to obtain an 8 contact relay.

The principles of the invention are described hereinabove by describing the construction of alternating preferred embodiments utilizing those principles. It is contemplated that the described embodiments are exemplary and that modifications to or changes in them can be made while remaining within the scope of the invention as defined by the appended claims.

We claim:

1. An electromagnetic relay operative according to the flux superposition principle and comprising:

a tubular plastic coil form having a hollow longitudinal shaft, at least one longitudinal guide carried inside said longitudinal shaft, a transverse flanged member carried at each end of said longitudinal shaft, each of said flanged members having at least one hole with the respective holes of said flanged members being in longitudinal alignment;

an exciting coil wound around the outside of said longitudinal shaft between said flanged members;

at least one hollow plug-in shaft having a cross-sectional shape which mates with the shape of said holes and longitudinal guides in its interior, said plug-in shaft being supported in an aligned pair of holes in said flanged members;

a yoke having at least two parallel coplanar legs, said legs having adjacent free ends and adjacent base ends and being connected together at their base ends, one of the legs of said yoke being supported in the interior of said longitudinal shaft in cooperation with said longitudinal guide and another leg of said yoke being supported in the interior of said plug-in shaft in cooperation with the longitudinal guide therein;

a substantially L-shaped core member spaced from the plane containing the legs of said yoke, one leg of said L-shaped member being disposed parallel to said another leg of said yoke and supported in the interior of said plug-in shaft in cooperation with the longitudinal guide therein, and the other leg of said L-shaped member being disposed transverse to the legs of said yoke adjacent to the free ends thereof, said other leg of said L-shaped member having a free end which faces the free end of one of the legs of said yoke; and an armature serving as a contact member disposed between said yoke and said L-shaped member and supported in the interior of said longitudinal shaft in cooperation with said longitudinal guide therein.

2. A relay according to claim 1 wherein said yoke, said L-shaped member and said armature comprise iron circuit components, at least one of said iron circuit components comprising a leaf spring which cooperates with the guides in its respective shaft.

3. A relay according to claim 1 comprising a plurality of parallel plug-in shafts supported in aligned pairs of holes in said flanged members.

4. A relay according to claim 2 wherein each of said iron circuit components has a leading end which is first inserted into its respective shaft when the relay is assembled, each of said leading ends being provided with a soldering lug having a blade-type notched metal end.

5. A relay according to claim 4 wherein said blade-type ends comprise pressed bent components which are connected at one end to said soldering lugs and are retained adjacent the other end in recesses formed in one of said flanged members.

6. A relay according to claim 2 comprising a plurality of parallel plug-in shafts supported in aligned pairs of holes in said flanged members.

* * * * *